United States Patent [19]

Stocksiefen et al.

[11] Patent Number: 4,573,231

[45] Date of Patent: Mar. 4, 1986

[54] PIPE CLEANING DEVICE

[75] Inventors: Peter Stocksiefen, Asbach; Alfons Grüber, Linz, both of Fed. Rep. of Germany

[73] Assignee: Industrietechnik Kalenborn GmbH, Kalenborn bei Linz, Fed. Rep. of Germany

[21] Appl. No.: 599,078

[22] Filed: Apr. 11, 1984

[30] Foreign Application Priority Data

Apr. 11, 1983 [DE] Fed. Rep. of Germany ..... 3312958

[51] Int. Cl.[4] ..... B08B 9/04

[52] U.S. Cl. ..... 15/104.06 R; 15/104.15

[58] Field of Search ..... 15/104.06 R, 104.06 A, 15/104.15

[56] References Cited

U.S. PATENT DOCUMENTS

| | | | |
|---|---|---|---|
| 971,042 | 9/1910 | Hill, Jr. et al. | 15/104.06 R |
| 1,593,072 | 7/1926 | Haydock et al. | 15/104.06 R |
| 2,959,798 | 11/1960 | Cribley | 15/104.06 R |
| 3,130,431 | 4/1964 | Reinhart | 15/104.06 R |
| 3,262,143 | 7/1966 | Reinhart | 15/104.06 R |

FOREIGN PATENT DOCUMENTS

| | | | |
|---|---|---|---|
| 569632 | 4/1924 | France | 15/104.06 R |
| 459277 | 3/1975 | U.S.S.R. | 15/104.06 R |
| 633627 | 11/1978 | U.S.S.R. | 15/104.06 R |
| 971533 | 11/1982 | U.S.S.R. | 15/104.06 R |

*Primary Examiner*—Edward L. Roberts

*Attorney, Agent, or Firm*—Balogh, Osann, Kramer, Dvorak, Genova & Traub

[57] ABSTRACT

The invention relates to a pipe cleaning device for removing encrustations from pipelines, comprising a propulsion element with drive and cutting means. The special feature is a cutting head fitted with cutting wheels and acted upon by a collars/impact shaft system.

10 Claims, 3 Drawing Figures

PIPE CLEANING DEVICE

The invention relates to a pipe cleaning device for removing encrustations from pipelines, more particularly pipelines conducting water, comprising a propulsion element which is adapted to be moved through the pipeline and which acts on a cutting head, with pivotal joints between the individual parts of the device.

Waters, more particularly waste waters, as in sewer piping or for mining purposes or the like, carry with them various chemical elements which have the property or combining to form mineral salts under certain conditions. As a result, encrustations form which have particularly troublesome effects in pipeline systems. Calcium, magnesium, barium, strontium and alkaline earths in solution in the water are responsible for these encrustations. These elements, which are also referred to as being hardness-forming agents, form insoluble salts such as carbonates, sulphates, silicates or phosphates especially when there is a temperature increase in the water. These often very hard deposits result e.g. in cross-section narrowing in pipelines, thus increase in energy costs for the pumps, reduce the delivery capacity and readily result in disturbances in operation, damage to material, and repair costs, and thus prejudice operating reliability.

Known solutions, such as that described in German Pat. No. 1 248 390, use such "pipeline pigs". Driving is by means of a turbine. A plurality of elements are connected one behind the other, and the first of these elements cut and scrape. The turbine then follows, in the direction of movement, and then Y-shaped cutters for comminuting, and further comminuting cutters. The joints for the individual cutters are of umbrella-form construction. Constructional arrangement is relatively complicated, more particularly as regards the drive, which is a self-contained drive unit.

German Pat. No. 2 746 668 also describes a construction which involves quite considerable outlay, with a tension piston within the pipe cleaning device, the piston having its rear end acted upon hydraulically and being capable of displacement in opposition to the action of a spring in the longitudinal direction of the device, and being associated with an aperture throttling the inflow into the housing. A control valve is used for closing the front discharge apertures. A control movement is necessary to trigger the activity of the tension piston in the event of the device being retarded by encrustations in the device. A plurality of complicated parts are needed in order to achieve the desired action. The device operates in a complicated manner. A collar is arranged in an annular situation about the device in the region of the tension piston. Force is always applied to the cutting head from the piston.

In contrast, the invention has as its object to make such pipeline cleaning devices substantially simpler, less complicated, and more reliable in operation. More particularly it is intended to dispense with self-contained drives such as a tension piston, or turbine etc.

In a device of the kind specified initially, this is achieved, surprisingly, by a cutting head which is fitted with cutting wheels and which is acted upon by a collars/impact shaft system.

Advantageously two collars with a spring interposed between them are used, these collars occupying the entire pipe cross-section.

Advantageously a third collar is associated with the second collar, with a spacer tube therebetween.

The device is forced once hydraulically through the pipeline, and the fluid used can be the fluid normally conveyed in the pipe system, or a fluid introduced for cleaning purposes, more particularly water.

For example the line of piping to be cleaned is cleaned manually at its starting end to a sufficient extent to allow the pipe cleaning device to be inserted in its entirety. Then the pipeline is closed by a cover which is provided with a water connection union (neither shown here). The other end of the pipeline remains open. The cleaning device is forced through the pipeline hydraulically, and thus the fouling is removed.

The flow pressure of the medium is transmitted in the first instance to the rearmost collar and then (after forcing its way past) past this collar, to all three annular surfaces.

For this purpose incisions are preferably provided in the collar. At the same time the overflowing water in the region of the cutting head washes the detached encrustations towards the pipe exit. The flow pressure builds up a certain amount of force through the said discs or collars. If for example in the forward region the encrustations in the pipeline offer resistance to the wheels of the cutting head, a built-in spring is acted upon by the constantly present pressure in the rear region, and thus compressed. When the encrustations are released by the action of the cutting wheels in the front region, relaxation follows again. As a result, the device has a pulsatory movement imparted to it, so that the encrustations are detached from the pipe wall by short impacts. This operation is repeated in fractions of seconds. The advancing force is repeatedly built up again by the flow pressure present in the cleaning direction, whereas in the front region it is reduced again via incisions in the collar in the direction towards the pipe exit.

Preferably the collars are supported over a certain radial region (excluding an annular region externally) in order to ensure that they abut on the pipe wall.

The collar material may be preferably leather, rubber or even synthetic plastic material. The flowing medium subjects the device to repeated blows until the encrustation is removed.

It is surprising that to obtain the impulse on the cutting head it is sufficient simple to make water pressure act on all three collars, and then, because of the interposed spring, to have the rear portion of the device moved to and fro in its entirety. Advantageously, then, the entire rear drive portion transmits the operating impulse to the cutting head.

At the cutting head the axes of the substantially equal-size cutting wheels are arranged on a truncated cone surface, with the small diameter of the cone situated at the front.

It is advantageous if the cutting head is held by a clamping sleeve against a flange situated on the impact shaft, with interposition of the first collar.

The stiffening of the collars can be effected preferably by metal spring plates at the fluid impingement side. These metal spring plates are also arranged on the shaft and extend approximately up to three quarters of the inner diameter of the pipe, so that a spring collar area mounting to a quarter of the inner diameter of the pipe remains elastic.

The collars comprise preferably radial incisions, which are provided for the overflow of the fluid. These incisions are V-shaped, extending through for about 30 mm from the circumference.

The device also comprises, more particularly in the region between the collars at the cutting head side and the second collar, a universal joint which connects the guide shaft for the cutting head to the actual impact shaft. This makes it possible by virtue of the built-in universal joint to negotiate 90° bends up to a nominal width of 150 mm without difficulty.

Forms of embodiment of the invention will now be described in more detail by way of example with reference to the accompanying drawings; in these drawings.

Figure 1:
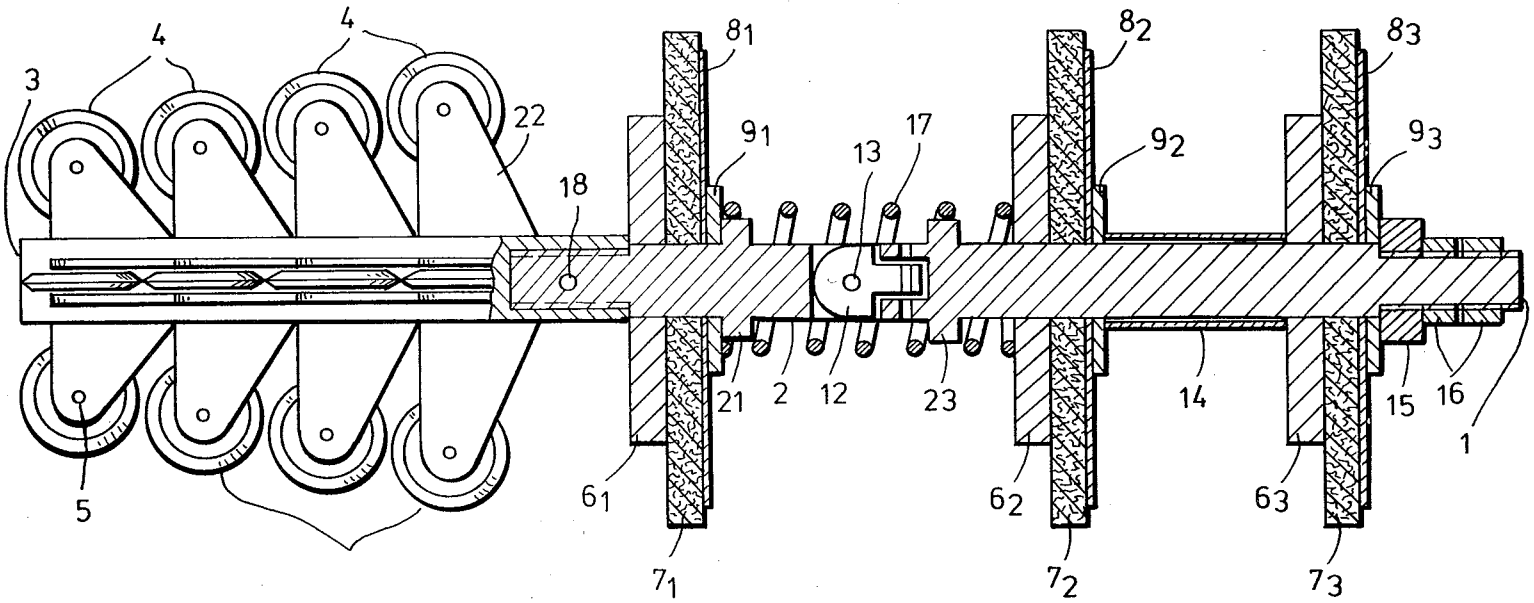
FIG. 1 shows a view partly in section through a form of embodiment of the invention.

According to FIG. 1 a through impact shaft 1 is connected to the guide shaft 2 by means of a universal joint 12. A cutting wheel head 3 is mounted on the guide shaft 2 by means of a clamping sleeve 18.

The guide shaft 2 has a flange 21 against which an inner perforate leather collar $7_1$ abuts with interposition of a metal spring plate $8_1$ which has a smaller diameter than the leather collar. At the cutting wheel head side the construction is completed by a base plate $6_1$ against which the clamping sleeve 18 of the cutting wheel head bears.

The cutting wheel head 3 carries groups of cutting wheels 4 which are arranged by means of screwthreaded bolts 5 on bearing plates 22. Each of the cutting wheels 4 is held between two respective bearing plates 22 by means of a screwthreaded bolt 5. The cutting wheels are arranged offset circumferentially by 45°. As FIG. 1 shows, forward cutting wheels 4 are arranged on plates of short radial length, the plates increasing conically in their radial extent in the direction towards the rear end of the device, so that the cutting wheels are situated on a conical generated surface or a trumpet-shaped generated surface i.e. one which widens more considerably than conical. In this way the result is achieved that the front wheels for example are already in engagement for cutting encrustations which extend far towards the middle of the pipe, whereas the later wheels cut closer and closer to the pipe wall. The last cutting wheels are then abutting lightly against the circumference of the pipe and, if the pipe is lined or is provided with a synthetic plastic material casing, they remain at a spacing which obviates damage.

By means of the clamping sleeve 18 both the cutting head in its entirety and also the cutting wheels can be interchanged. For example with another appropriate head it is possible also to remove relatively soft internal fouling from pipes. Then instead of the cutting wheels it would be possible to arrange suitable elements for example of brush type, elements which have less of a cutting action or do not cut at all, scraping elements, or the like.

Between the inner collar $7_1$ and a perforate central collar $7_2$ there is arranged between flange 21 and flange 23, there is extending over the flange 23, a spring 17 which is preloaded between the inner collar $7_1$ and the central collar $7_2$. The central collar is constructed similarly to the inner collar i.e. the collar $7_2$ is made of leather for example and is arranged in sandwich fashion between the base plate $6_2$ and the screwthreaded plate $9_2$. Moreover the spring extends over the universal joint, secured by the screwthreaded pin 13, between the two shafts.

The third arrangement, at the fluid side, again has like the preceding arrangements a base plate $6_3$, an outer perforate leather collar $7_3$, metal spring plate $8_3$ and screwthreaded plate $9_3$. Here the screwthreaded plate $9_3$ is held by a screwthreaded nut 16 by means of a spacer sleeve 15.

Figure 2:
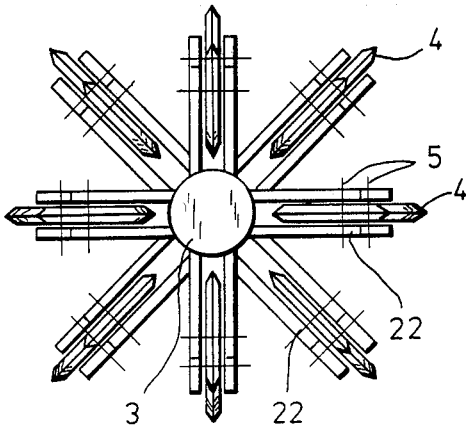
FIG. 2 shows an end-on view of a detail of FIG. 1.

FIG. 2 shows an end view of the cutting wheel head shown in FIG. 1, and illustrates how the bearing plates 22 support the respective cutting wheels 4. The axes indicated by means of broken lines represent the screwthreaded bolts 5, which are situated on a conical generated surface. The bearing plates are advantageously arranged on a clamping sleeve 18 adapted to be fitted on to the guide shaft, so that the entire head can be interchanged.

Figure 3:
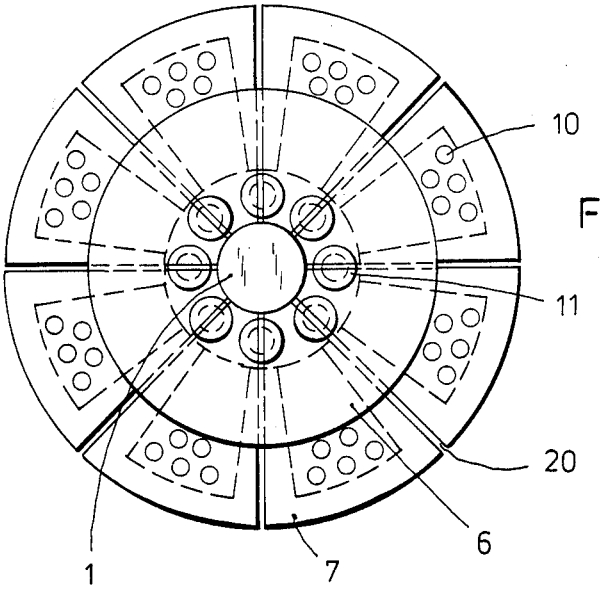
FIG. 3 shows an individual part (collar) in side or front view.

FIG. 3 shows how the collars 7 have incisions at 20. Countersunk rivets 10 hold the supporting elements, and countersunk screws 11 are used for through fastening. The arrangement is arranged on the impact shaft 1, or, in the case of the arrangement carrying the inner leather collar $7_1$, on the guide shaft 2.

Thus the preloading spring 17 is compressed between two discs when fluid arriving in the arrow direction acts on first of all the first arrangement equipped with the outer leather collar $7_3$ and then, after passing through the leather collar, the second and third arrangements with the leather collars $7_2$ and $7_3$. The preloading spring 17, which is compressed hydraulically through the leather collar arrangements, is relaxed by the forward movement of the cleaning head 3. This operation is repeated in split seconds.

We claim:

1. A pipe cleaning device for removing encrustations from pipelines, more particularly pipelines conducting water, foul water or water for mining purposes, comprising a propulsion element which can be moved by hydraulic pressure through the pipeline, said propulsion element comprising spaced outer, central and inner collars, an impact shaft, said central and outer collars being slidably mounted on said impact shaft, a guide shaft, said inner collar being secured on said guide shaft, means for pivotally coupling one end portion of said guide shaft to one end portion of said impact shaft, a cutting head which is fitted with a plurality of spaced cutting wheels and supported on the other end portion of said guide shaft, said collars substantially spanning the cross-sectional area of the pipeline, characterized in that, between the central and inner collars, there is slidably positioned on the coupled end portions of said shafts, a preloaded spring, each of said three collars being provided with spaced radial incisions for accommodating the passage of fluid applied under pressure to said outer collar, whereby initial application of the hydraulic pressure to said outer collar will transmit an impact to said central collar to further compress said preloaded spring, which in turn applies an impact to said inner collar to drive said cutting head further into said pipeline.

2. A pipe cleaning device according to claim 1, characterized in that said central and inner collars are provided with planar surfaces.

3. A pipe cleaning device according to claim 2, characterized by a spacer tube situated between said central collar and said outer collar.

4. A pipe cleaning device according to claim 3, characterized in that the collars are made of a material such as leather, rubber and synthetic plastic material.

5. A pipe cleaning device according to claim 3, characterized in that the central and inner collars and the interposed spring can move to and fro in its entirety, in such a manner that in this way the impulse of said collars is transmitted to the cutting wheels.

6. A pipe cleaning device according to claim 2, characterized in that said means for pivotally coupling one end portion of said guide shaft to one end portion of said impact shaft comprises an universal joint.

7. A pipe cleaning device according to claim 1, characterized in that metal spring plates are associated with the collars for stiffening at the fluid impingement side.

8. A pipe cleaning device according to claim 1, characterized in that the impulse of a flowing fluid, more particularly water, is transmitted to all the collars, more particularly by means of the incisions.

9. A pipe cleaning device according to claim 1, characterized in that axes of the substantially equal-size cutting wheels are arranged on a frusto-conical generated surface, with the small diameter of the frusto-conical generated surface being situated at front end of said cutting head.

10. A pipe cleaning device according to claim 1, characterized in that the guide shaft is provided with a flange abutting one side of the inner collar, and a clamping means abutting the other side of said inner collar and removably securing said cutting head to said guide shaft.

* * * * *